United States Patent [19]

Haslam et al.

[11] 4,380,461

[45] Apr. 19, 1983

[54] RECOVERY OF HYDROGEN FROM AMMONIA SYNTHESIS PURGE GAS

[75] Inventors: Alan A. Haslam, Stockport; Wieslaw H. Isalski, Sale; Terence R. Tomlinson, Stockport, all of England

[73] Assignee: Petrocarbon Developments Ltd., Manchester, England

[21] Appl. No.: 208,940

[22] Filed: Nov. 21, 1980

[30] Foreign Application Priority Data

May 10, 1979 [GB] United Kingdom ..... 7916187

[51] Int. Cl.[3] ..... F25J 3/00

[52] U.S. Cl. ..... 62/11; 62/23; 62/31

[58] Field of Search ..... 62/23–28, 62/31, 11

[56] References Cited

U.S. PATENT DOCUMENTS

| | | | |
|---|---|---|---|
| 2,849,867 | 9/1958 | Haringhuizen | 62/31 |
| 3,359,744 | 12/1967 | Bolez et al. | 62/23 |
| 3,363,428 | 1/1968 | Charlesworth | 62/23 |
| 3,433,027 | 3/1969 | Charlesworth et al. | 62/23 |
| 3,626,705 | 12/1971 | Knapp et al. | 62/23 |
| 4,229,195 | 10/1980 | Forg | 62/23 |
| 4,239,647 | 12/1980 | McNeil | 62/17 |

*Primary Examiner*—Norman Yudkoff

*Attorney, Agent, or Firm*—Kirschstein, Kirschstein, Ottinger & Cobrin

[57] ABSTRACT

In a process for the recovery of hydrogen from compressed purge gas withdrawn from a recyling gas stream of an ammonia synthesis wherein the hydrogen is separated from the purge gas by partial condensation at cryogenic temperatures, refrigeration is provided by expanding and evaporating the condensate so formed, and the partial pressure of the expanded condensate is lowered by withdrawing a bleed stream from said uncondensed gas, expanding said bleed stream and injecting it into said expanded condensate, condensation of nitrogen employed to purge the cold box for the cryogenic process is avoided by either injecting into the bleed stream a warmer gas provided from the uncondensed gas and/or the purge gas or expanding the condensate and bleed stream in stages with separate expansion thereof in an initial stage and injection of the bleed stream into the condensate prior to the final stage.

6 Claims, 3 Drawing Figures

RECOVERY OF HYDROGEN FROM AMMONIA SYNTHESIS PURGE GAS

This invention relates to the recovery of hydrogen from the purge gas withdrawn from the recycling gas stream in an ammonia synthesis process and in particular to an improvement in the process wherein the hydrogen is recovered by the partial condensation of the purge gas at sub-ambient temperatures and superatmospheric pressure and the refrigeration for the process is provided by expanding and evaporating condensate formed by the partial condensation.

To obtain hydrogen of suitable purity by such a process, it has generally been found necessary to cool the purge gas to about 85°–90° K., when hydrogen of about 90% purity or better can be recovered. A purity of about 90–91% is desirable where the recovered hydrogen is to be recycled to the ammonia synthesis plant since this enables the maximum amount of nitrogen to be returned with the hydrogen, compatible with the permissible content of argon and methane in the recycled stream. The precise level of purity to achieve this will depend upon the constitution of the purge gas stream.

It has recently been found advantageous to expand a small portion of the purified hydrogen and inject it into the expanded condensate in order to lower the partial pressure of this condensate. The object of this procedure may be to lower the temperature interval in which the condensate evaporates, as disclosed in UK Pat. Nos. 1,057,020 and 1,136,040, or to raise the pressure at which the condensate evaporates, while retaining the same range of temperatures, as disclosed in UK Pat. No. 1,460,681. In either case, it is preferable to withdraw the injection stream from the purified hydrogen at a low temperature in order not to warm the condensate and thereby reduce its ability to cool the incoming purge gas although in certain cases, as disclosed in UK Pat. No. 1,460,681, it may be necessary to withdraw the injection stream at a slightly higher temperature in order not to cool the condensate to a temperature at which some of the methane and argon contained in it might solidify.

The expansion of this injection stream prior to injecting it into the expanded condensate, however, can result in a substantial drop in the temperature of the stream and this temperature drop has caused problems in ammonia purge gas treatment plants of the conventional kind which employ nitrogen gas to purge the cold box which houses the cryogenic equipment. This is because this expansion of the injection stream, which can contain up to 10% impurities, not infrequently can cause its temperature to drop below the temperature (77° K.) at which nitrogen condenses. This in turn can lead to condensation of the nitrogen used for purging the cold box on the cold surfaces and destabilisation of the purging operation. In particular such conditions can lower the pressure inside the cold box and lead either to the ingress of oxygen containing air or to collapse of the box itself.

This problem is exacerbated by the recent trend towards higher pressures for effecting the partial condensation of the purge gas and consequently greater pressure drops of the injection stream on expansion.

Attempts to overcome the problem by insulating the relevant pipework within the cold box have proved unsatisfactory.

In principle, the problem could be overcome by withdrawing the injection stream at a higher temperature from the purified hydrogen gas stream obtained by the partial condensation but in modern plants where only one heat exchanger is used for the cooling of the purge gas from near ambient temperature, there is no convenient point in the plant from which the injection stream could be withdrawn at a suitable temperature. Moreover, hitherto it has been considered that raising the temperature of the injection stream would adversely affect the net yield of hydrogen gas from the plant to an unacceptable extent.

It has now surprisingly been found in accordance with this invention, however, that the aforementioned problem can be overcome without substantially adversely affecting the net yield of hydrogen from the plant to any significant extent even though the solution involves increasing the temperature at which the expanded injection stream is provided for injection into the expanded condensate.

BRIEF DESCRIPTION OF THE DRAWINGS

In the accompanying drawings, in which are shown various possible embodiments of the invention.

Figure 1:
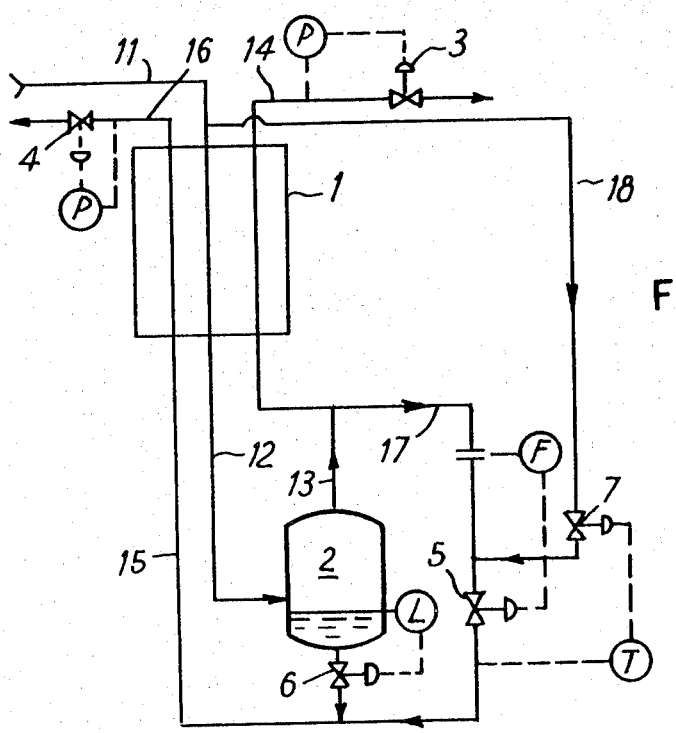
FIG. 1 is a flow sheet of the cold portion of a plant for recovering hydrogen from the purge gas of an ammonia synthesis plant and illustrating an embodiment of the invention in which a small stream of feed gas is branched off through a line 18 and passed through a valve 7 into a line 17 upstream of an expansion valve 5.

In one method according to the invention, the temperature of the injection stream is prevented from dropping to 77° K. after expansion thereof for injection into the expanded condensate, by introducing into the injection stream a flow of warmer gas.

This warmer gas may advantageously be provided from the purified hydrogen gas stream after it has exited from the heat exchanger or, preferably, from the purge gas before it passes through the heat exchanger. In the former case, the resulting loss in product gas is almost entirely offset by a corresponding reduction in the size of the injection stream but as the stream obtained by combination of the warm gas and the injection stream will be slightly warmer than the unmodified injection stream, the amount of this combined stream required for treatment of the expanded condensate will be slightly greater and thus the net yield of hydrogen product gas will be slightly reduced. However, the reduction is so small as to be generally insignificant. In the preferred case of using purge gas, the reduction in net yield of hydrogen product gas is even smaller because of the lower concentration of the hydrogen in the purge gas. Use of purge gas as the source of warm gas is also preferred because the purge gas is at a higher pressure than the purified hydrogen gas stream and therefore the available pressure differential is greater, thus facilitating control.

Depending upon the pressure of the warmer gas, it may be introduced into the injection stream upstream of the expansion valve or sufficiently close to the throat of the expansion valve on the downstream side to ensure that the valve itself is not cooled to 77° K. Where purge gas is used to supply the warmer gas, the former alternative will normally be applied but where the warm gas is provided from hydrogen product gas, the latter arrangement will normally be used.

In a preferred alternative method, the pressure drop to which the injection stream is subjected by expansion is limited to prevent the temperature of the stream dropping to as low as 77° K., the condensate is expanded to substantially the same pressure as the expanded injection stream and thereafter the injection stream and expanded condensate are combined and the combined stream is expanded to the final pressure required to achieve the desired refrigeration.

A combination of the above methods may be employed if desired.

By means of this invention it is possible to prevent the temperature of the injection stream from falling to 77° K. while retaining the capacity of the injection stream to lower the partial pressure of the condensate without a significant reduction in the net yield of hydrogen product gas.

Since no advantage is achieved by use of higher temperatures, the injection stream after expansion will not normally be at a temperature greater than 79° or 80° K.

The invention is now described in greater detail with reference to two embodiments thereof and with the aid of the accompanying drawings showing the flow sheet of the cold portion of a plant for recovering hydrogen from the purge gas of an ammonia synthesis plant.

Figure 2:
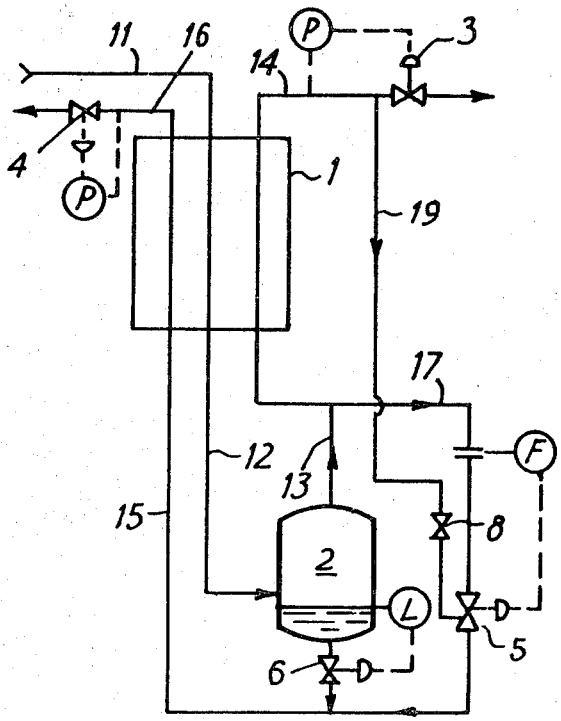
FIG. 2 is a flow sheet similar to FIG. 1, but illustrating another embodiment of the invention in which a small stream of hydrogen product is branched off from a line 14 as shown by a line 19 and introduced through a needle valve 8 into a tapping in an expansion valve 5 downstream of the throat of said valve.

Referring to FIGS. 1 and 2, 1 is a heat exchanger and 2 is a liquid/vapour separator. 3 and 4 are pressure controlled valves, 5 is a flow controlled valve, 6 a level controlled valve and 7 a valve controlled by temperature.

Ammonia purge gas, from which moisture and other undesirable impurities have been removed, enters the cold portion of the plant through line 11 at near ambient temperature and a pressure which may vary from about 40 to 80 bar. It is cooled in exchanger 1 to 85°–90° K., in the course of which the bulk of the constituents apart from hydrogen condense. The mixture then passes through line 12 to separator 2 and the enriched gaseous hydrogen stream leaves the separator through line 13 and is warmed to near ambient temperature in exchanger 1 leaving through line 14 and pressure controlled valve 3.

The condensate is expanded to a low pressure, which may be 2–7 bar, in level controlled valve 6 and returns through line 15 and exchanger 1 where it is evaporated by and thereby cools and partially condenses the purge gas in line 11, and leaves through line 16 and pressure controlled valve 4.

To lower the vapor pressure of the condensate, a small stream of hydrogen product at about 85°–90° K. is branched off through line 17, expanded in flow controlled valve 5 and injected into the condensate.

The introduction of warm gas to reduce the temperature drop in valve 5 can now be effected in two ways. Either a small stream of feed gas is branched off through line 18 and passed through valve 7 into line 17 upstream of expansion valve 5 as illustrated in FIG. 1, or as shown in FIG. 2, a small stream of hydrogen product is branched off from line 14, as shown by line 19, and introduced through needle valve 8 into a tapping in expansion valve 5 downstream of the throat.

Figure 3:
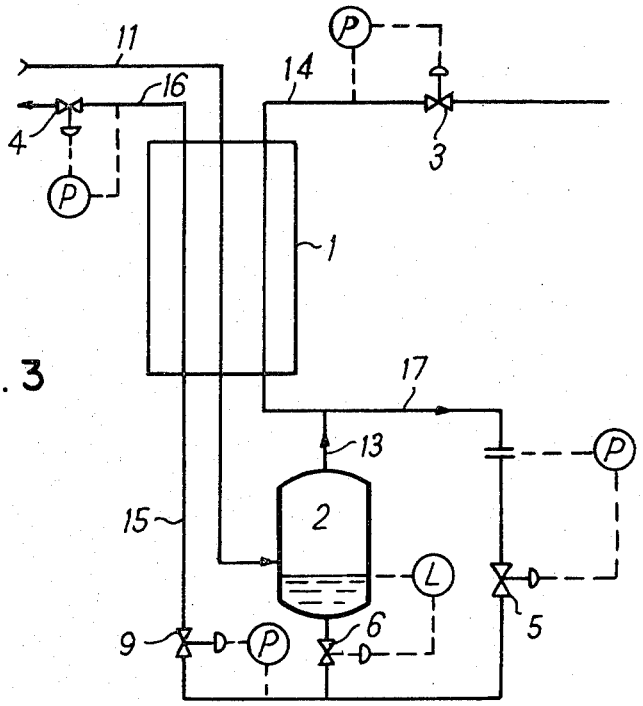
FIG. 3 is another view similar to FIG. 1 of another embodiment of the invention, in which the injection stream is relatively large and the hydrogen is to be maintained as high as possible. In this Figure, lines 18 and 19 and the valves 7 and 8 of the flow sheets of FIGS. 1 and 2 are omitted and are replaced by an additional pressure controlled valve 9 in the line 15. Also, the injection stream of the line 17 is expanded in two stages, first to an intermediate pressure in the expansion valve 5 before it is combined with the condensate and subsequently when it is already mixed with the condensate in an expansion valve 9 to the lower pressure, at which the evaporated condensate is to be recovered.

The second method, which is preferred when the injection stream is relatively large and the hydrogen recovery is to be maintained as high as possible, is illustrated in FIG. 3, in which the same numerals as in FIGS. 1 and 2 are used where appropriate. Lines 18 and 19 and valves 7 and 8 of the arrangement of FIGS. 1 and 2 are here omitted and are replaced by an additional pressure controlled valve 9 in line 15. The injection stream in line 17 is now expanded in two stages, first to an intermediate pressure in expansion valve 5 before it is combined with the condensate and afterwards, when it is already mixed with the condensate, in expansion valve 9 to the lower pressure at which the evaporated condensate is to be recovered. It will be understood that in this arrangement the condensate is expanded in valve 6 to the intermediate pressure to which the injection stream is expanded in valve 5.

In this way the temperatures in valves 5 and 9 and in the accompanying pipe lines are maintained above the condensing point of nitrogen without any further loss of hydrogen recovered.

The following example illustrates the result of operating both methods:

400 kg mols/hrs of purge gas from an 1150 short ton per day ammonia plant are fed through line 11 into the hydrogen recovery plant at a pressure of 70 bar with the following composition:

| | m % |
|---|---|
| $H_2$ | 64 |
| $N_2$ | 22 |
| AR | 5 |
| $CH_4$ | 9 |
| | 100 |

and the plant conditions are such that 260 kg mols/hr of hydrogen product are recovered in line 14 having the composition

| | m % |
|---|---|
| $H_2$ | 90.0 |
| $N_2$ | 8.8 |
| AR | 0.8 |
| $CH_4$ | 0.4 |

The temperature in the separator is 88° K.

If the evaporated condensate in line 15 is required at 4 bar, 5 kg mols of hydrogen product are withdrawn in line 17 and injected through valve 5. Without the use of the invention the temperature downstream of valve 5 would fall to 72° K. i.e. well below the boiling point of nitrogen. By adding 0.15 Kg mol/hr of warm purge gas through valve 7 this temperature is raised to 79° K.

If the evaporated condensate in line 16 is required at 7 bar, 20 Kg mol/hr of hydrogen product have to be withdrawn in line 17 and injected through valve 5 and, without the use of the invention, the temperature would fall to 73° K. By introducing the back pressure valve 9 and maintaining a pressure of 25 bar upstream of this valve, the temperature of the injection stream does not fall below 79° K.

We claim:

1. In a process for the recovery of hydrogen from purge gas withdrawn from a recycling gas stream of an ammonia synthesis, which process comprises at superatmospheric pressure cooling the purge gas to sub-ambient temperature to form a condensate comprising components having a boiling point above that of hydrogen and uncondensed gas rich in hydrogen and separating said uncondensed gas from said condensate;

providing refrigeration for said cooling by expanding condensate and passing said expanded condensate and said uncondensed gas separately in indirect countercurrent heat exchange relationship with said purge gas, with evaporation of said expanded condensate; and lowering the partial pressure of said expanded condensate by withdrawing a bleed stream from said uncondensed gas prior to said heat exchange, expanding said bleed stream and injecting it into said expanded condensate prior to said heat exchange; the improvement wherein the bleed stream contains less than 10% impurities and the minimum temperature of said bleed stream after said expansion thereof is prevented from falling below 77° K.

2. A process as claimed in claim 1, wherein said minimum temperature is prevented from falling below 77° K. by injecting a warmer gas into said bleed stream after expansion thereof, said warmer gas being provided from said uncondensed gas after said heat exchange.

3. A process as claimed in claim 1, wherein said minimum temperature is prevented from falling below 77° K. by injecting a warmer gas into said bleed stream before expansion thereof, said warmer gas being provided from said purge gas before said heat exchange.

4. A process as claimed in claim 1, wherein said minimum temperature is prevented from falling below 77° K. by effecting said expansion of the condensate and said expansion of the bleed stream in two stages, the condensate and bleed stream being separately expanded in an initial stage of the expansion and the bleed stream being injected into said condensate prior to the final stage of expansion.

5. A process as claimed in claim 4, wherein a warmer gas provided from said uncondensed gas after said heat exchange and/or from said purge gas before said heat exchange is injected into said bleed stream to increase the minimum temperature attained by said bleed stream as a result of said expansion of said bleed stream prior to injection of said bleed stream into said condensate.

6. A process as claimed in claim 1, wherein the temperature of said bleed stream prior to injection into said condensate is above 77° K. but not greater than 80° K.

* * * * *